US008627544B2

(12) United States Patent
Habboush

(10) Patent No.: US 8,627,544 B2
(45) Date of Patent: Jan. 14, 2014

(54) DEBRIS COLLECTING APPARATUS AND METHODS OF MAKING AND USING THE SAME

(75) Inventor: Sarmad J. Habboush, La Mesa, CA (US)

(73) Assignee: Sarmad J. Habboush, Bala Cynwyd, PA (US)

( * ) Notice: Subject to any disclaimer, the term of this patent is extended or adjusted under 35 U.S.C. 154(b) by 558 days.

(21) Appl. No.: 12/876,849

(22) Filed: Sep. 7, 2010

(65) Prior Publication Data

US 2011/0179597 A1 Jul. 28, 2011

Related U.S. Application Data

(60) Provisional application No. 61/336,891, filed on Jan. 28, 2010.

(51) Int. Cl.
*A47L 9/06* (2006.01)

(52) U.S. Cl.
USPC ..... 15/401; 15/415.1; 15/344; 15/236.01

(58) Field of Classification Search
USPC ..... 15/401, 415.1, 322, 344, 327.5, 236.01, 15/410, 402, 399, 400
See application file for complete search history.

(56) References Cited

U.S. PATENT DOCUMENTS

| | | | | |
|---|---|---|---|---|
| 3,082,466 | A * | 3/1963 | Tucker et al. | 15/415.1 |
| 5,718,016 | A * | 2/1998 | Sung | 15/339 |
| 6,154,918 | A * | 12/2000 | Cain et al. | 15/327.5 |
| 7,320,634 | B1 * | 1/2008 | Minick | 451/344 |

* cited by examiner

*Primary Examiner* — Dung Van Nguyen
(74) *Attorney, Agent, or Firm* — Bernard L. Kleinke; Duckor Spradling Metzger & Wynne

(57) ABSTRACT

A system and method are disclosed for a suction nozzle for attachment to a vacuum source, such as a suction line, to collect debris such as airborne particles. The suction nozzle includes a tubular-shaped funnel with a large mouth at one end, to receive and channel airborne debris to the vacuum source. The suction nozzle also includes a connector at an opposite end of the funnel, for connecting the suction nozzle to a vacuum source. The mouth of the funnel may further include an inwardly-extending rim portion, which is shaped to accommodate objects that may be adjacent to the funnel and its mouth. The mouth includes a lip extending inwardly from the rim of the mouth for helping deflect debris inwardly into the funnel. In one embodiment, the rim portion of the funnel mouth may further include a scraper portion which extends inwardly from the rim, toward the interior of the funnel mouth. This scraper portion is useful for helping to remove debris from instruments or other.

15 Claims, 5 Drawing Sheets

DEBRIS COLLECTING APPARATUS AND METHODS OF MAKING AND USING THE SAME

RELATED APPLICATION

This application claims priority to U.S. Provisional Patent Application Ser. No. 61/336,891, filed Jan. 28, 2010 and entitled "Chair side dental dust collector suction adapter," which is incorporated herein by reference.

FIELD OF THE INVENTION

This application generally relates to the field of debris-collecting devices, and, more particularly, to suction nozzles connected to a vacuum source for the collection of debris, such as dust particles and others, produced in, and resulting from, a variety of operations such as grinding and machining operations, as well as the operation of power tools and others.

BACKGROUND OF THE INVENTION

There is no admission that the background art disclosed in this section legally constitutes prior art.

As discussed above, this application generally relates to devices for the collection of debris in various environments. This field includes several examples of debris-collecting devices. For instance, U.S. Pat. No. 4,226,054 describes a particle collector that utilizes a vacuum in connection with intercepting and collecting small particles dislodged during grinding operations of dentists and jewelers. U.S. Pat. No. 5,718,016 describes a deformable glove which includes a plurality of flexible suction nozzle tubes that extend along and are deformable with the movement of a user's fingers. The flexible nozzle tubes are connectable to the input port of a vacuum cleaner, so that air may be drawn into the vacuum cleaner through the flexible nozzle tubes as a user moves his or her hand around and along areas to be cleaned. Also, U.S. Pat. No. 4,671,708 discloses a device for collecting debris from grinding, polishing, or other work removal operations, and for simultaneously cooling the work. This device includes a scoop with a base outlet and a suction device for creating a flow of gas through the scoop, to facilitate the induction of debris entering a base outlet of the scoop.

By their nature, grinding and machining processes necessarily result in the generation of debris, such as dust and particles. During grinding and machining operations, very fine particles of dust and material may become airborne and alight on surfaces of the surrounding workplace, creating a dust-covered workplace, or creating potential hazards, depending on the nature of the particles. For example, under certain circumstances, the suspension in air of combustible materials, such as fine sawdust particles, in an enclosed space may create the potential for explosions or other unsafe conditions. In addition, dust and material resulting from a grinding or machining operation may be suspended in the air and may be inhaled by persons in the vicinity of the grinding or machining operation, such as the operator of the grinding tool, an observer of the operation, or other bystander.

Such inhaled particles and material may be injurious to the inhaler, depending on their nature. For example, long-term inhalation of dust may cause respiratory injury, such as lung discomfort, allergic reactions in persons with asthma, or other conditions requiring medical treatment. Furthermore, in some situations, minute particles suspended in the air surrounding a grinding or machining workplace may enter and injure the eyes of persons in the vicinity of the grinding or machining operation. Such potential health and safety risks may in addition to the increased effort required to clean fine dust and debris particles and maintain a clean workspace environment in the area where such grinding or machining takes place.

Dental practitioners frequently employ small hand-held, or table-top grinding devices, for shaping and polishing dental prostheses. Performing grinding operations on dental prostheses is typically convenient when performed in a dentist's office, while a patient is still seated in a nearby dentist's chair. This allows the dentist or technician to work on the dental prosthetic in the vicinity of the patient, so that the fit of a prosthetic in the patient's mouth may be quickly checked while working on the prosthetic, thus allowing for rapid alternating iterations of work on the workpiece, and fitting in the patient's mouth. A precise fit may thus be achieved quickly, as opposed to working on the workpiece remotely from the patient, if the grinding tools were in a different location such as in a different room or in another facility and having to physically transport the workpiece to a patient located some distance away from the grinding location.

As discussed more generally, above, grinding a dental prosthetic releases particles such as dust, and other debris into the air, which may alight on objects and surfaces in the vicinity of the grinding, thus necessitating frequent and tedious clean-up of small particles. The debris may also become suspended in the nearby air, creating respiratory hazards. In a dental environment, especially where a dental prosthetic is being rapidly cycled between a grinding operation, and fitting in a patient's mouth, other materials from a patient's mouth, such as saliva and blood, may be released into the atmosphere in the course of the grinding operation after the prosthetic has been in the patient's mouth. The release of such materials into the air may present cross-contamination and other health risks for the dentist or technician working on the prosthetic, in addition to those described above such as inhalation and contact with the eyes. Furthermore, other patients may be subject to the same health risks in multi-patient environments, such as in a dental school setting, or multi-patient dentist office. Moreover, the debris and particles released in such grinding operations may alight on a patient's hair and clothing, resulting in discomfort, annoyance, and the need for cleaning. Specialized cleaning procedures may also be required for the work area in which such materials may be released in order, to maintain the cleanliness and sterility of a workspace near dental patients.

BRIEF DESCRIPTION OF THE DRAWINGS

To provide better understanding of the invention and to demonstrate how the same may be carried out in practice, non-limiting embodiments of the invention will now be described with reference to the accompanying drawings, wherein like reference characters refer to like parts throughout the several views, and in which.

DETAILED DESCRIPTION OF CERTAIN EMBODIMENTS OF THE INVENTION

Figure 1:
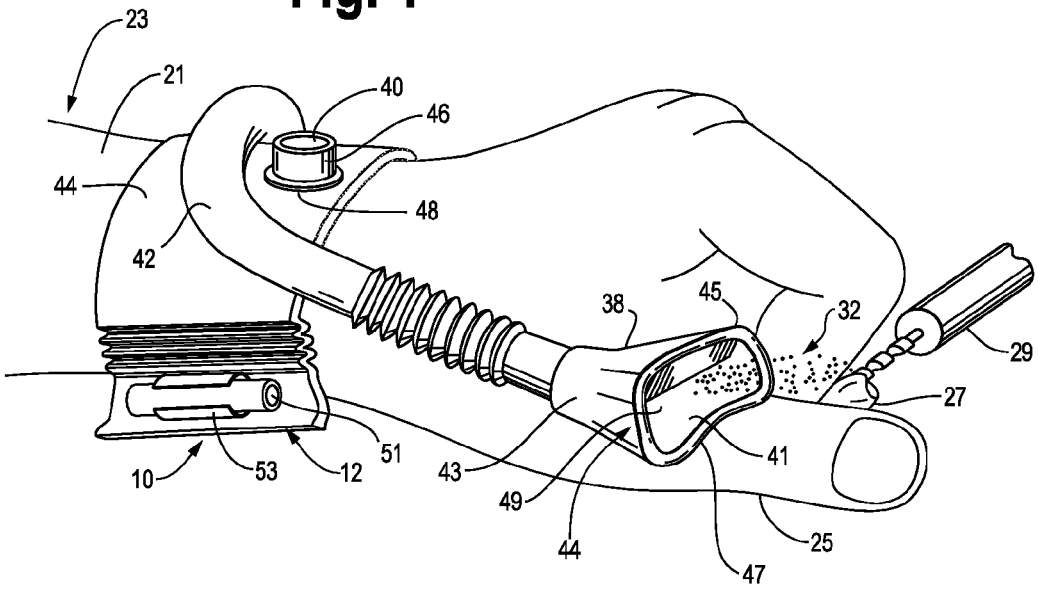
FIG. 1 is a pictorial view of an embodiment of the present invention, illustrating use of the invention with a rotary grinder.

Certain embodiments of the present invention will now be described more fully hereinafter with reference to the accompanying drawings, in which some, but not all, embodiments of the invention are shown. Indeed, these embodiments of the invention may be in many different forms and thus the invention should not be construed as limited to the embodiments set forth herein; rather, these embodiments are provided as illustrative examples only so that this disclosure will satisfy applicable legal requirements. Like numbers refer to like elements throughout.

It will be readily understood that the components of the embodiments as generally described and illustrated in the drawings herein, could be arranged and designed in a wide variety of different configurations. Thus, the following more detailed description of the certain embodiments of the system, components and method of the present invention, as represented in the drawings, is not intended to limit the scope of the invention, as claimed, but is merely representative of illustrative examples only of the invention.

According to certain embodiments of the present invention, there is provided a suction nozzle for attachment in fluid communication with a vacuum source, such as a suction line, to collect debris, such as airborne particles. The nozzle includes a funnel having a large mouth at one end to receive the debris, and an opposite small end for coupling to the vacuum source. An inwardly extending portion of the mouth may be shaped to accommodate closely spaced adjacent objects such as other such tubes when the inventive suction nozzle is employed, for example, at a dental chair. A lip may extend inwardly from the rim to help deflect debris inwardly in the funnel.

Accordingly, this application discloses a suction nozzle for attachment in fluid communication with a vacuum source, such as a suction line, to collect debris. The suction nozzle includes a tubular-shaped funnel with a large mouth at one end, to receive and channel airborne debris to the vacuum source. The suction nozzle also may include a connector at an opposite end of the funnel, for connecting the suction nozzle to a vacuum source. The mouth of the funnel further may include an inwardly extending rim portion, which is shaped to accommodate objects that may be adjacent to the funnel and its mouth. The rim portion of the funnel mouth may further include a scraper portion, and which extends inwardly from the rim, toward the interior of the funnel mouth. This scraper portion is useful for helping to remove debris from instruments or other.

For the convenience of the user, the debris-collecting apparatus disclosed in this application may also be configured to be mounted to an operator's limb, near an operator's digit, so that it may be positioned close to a hand-held grinder and workpiece while the user is grinding or machining the workpiece. In another embodiment, the debris-collecting apparatus may be attached to a telescoping tube that is rotatably mounted to a wall in the vicinity of the working area.

According to another embodiment of the present invention, a funnel-shaped nozzle includes a lip extending inwardly from the rim of the nozzle mouth, to prevent debris, liquid, and other materials that may enter the nozzle mouth, from bouncing or splashing out of the nozzle.

According to yet another embodiment of the present invention, a nozzle assembly includes a tubular funnel-shaped nozzle with a large mouth for receiving debris at one end, and a small connector portion at the other end for attaching the nozzle to a vacuum source. According to an aspect of this embodiment, the nozzle mouth may include a rim that extends inwardly along at least a portion thereof, to accommodate objects adjacent to the nozzle. According to another aspect of this embodiment, a scraper may extend inwardly from the rim of the nozzle mouth, for helping remove debris from instruments. The nozzle assembly may further include a cuff attached to the funnel-shaped nozzle, for attachment of the nozzle assembly to a user's limb.

According to another embodiment of the present invention, a nozzle assembly includes a manifold having a number of ports, and a small connector portion for attaching the nozzle assembly to a vacuum source, such as a suction line. Such a nozzle assembly may further include at least one tubular funnel-shaped nozzle attached to one or more of the ports, and each of the funnel-shaped nozzles may have a large mouth. In an aspect of this embodiment, the nozzle assembly may include a cuff for attaching the nozzle assembly to a user's limb.

A further embodiment relates to the method of using the nozzle assembly as being worn by the user during use. Also another embodiment relates to the method of making the nozzle of the present invention.

Figure 2:
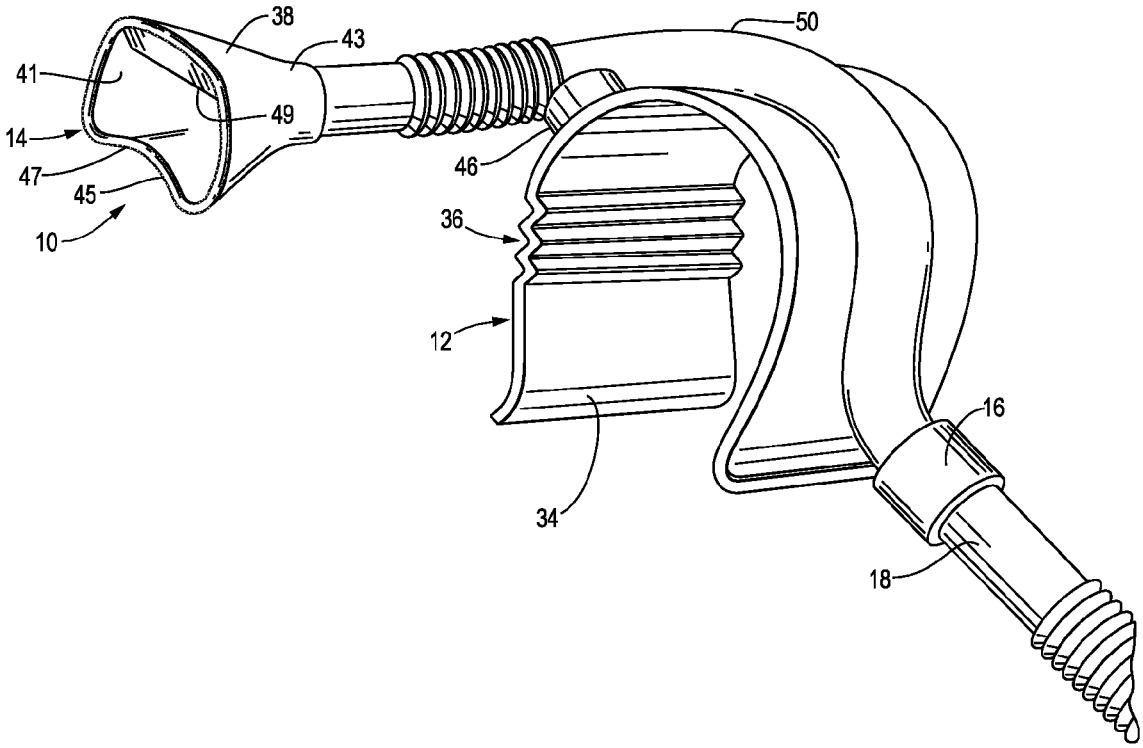
FIG. 2 is a pictorial view of the embodiment illustrated in FIG. 1, illustrating in the process of being used.

Referring now, to the drawings, FIGS. 1 and 2 illustrate an embodiment of the debris collecting apparatus 10 according to the present invention. The debris collecting apparatus 10 includes a wrist-engageable portion, or cuff 12, and a suction nozzle 14. As illustrated in FIG. 2, a connector 16 provides for attachment of the debris collecting apparatus 10 to a vacuum source such as a suction line 18. Many types of connectors are known in the art for attaching lengths of tubing, such as suction line, to each other, or for the attachment of various types of attachments to tubing. Such connectors known in the art may include detachable, or quick-disconnect connectors for disconnection for cleaning, storage, maintenance, or the quick change of suction line attachments. It is thus to be appreciated that, in keeping with the scope of the present invention, any appropriate connecting method known in the art may be used for attaching the debris collecting apparatus 10 to a suction line 18.

As further contemplated by an embodiment of the present invention the cuff 12 provides for attachment of the debris collecting apparatus 10 to a portion of a user's limb 23, such as a user's wrist 21, as illustrated in FIG. 1. Attaching the debris collecting apparatus 10 to the user's limb 23 facilitates the positioning of the suction nozzle 14 in close proximity with, or in contact with a user's digit, such as the user's thumb 25.

FIG. 1 further illustrates that the suction nozzle 14 may thus be positioned in close proximity to a workpiece such as a dental prosthetic 27, as a user is holding the workpiece 27 with the limb 23 to which the debris cleaning apparatus 10, is attached and performing a grinding operation on the workpiece 27 with a grinding tool 29. This proximate location of the suction nozzle facilitates effective capture and suction of dust 32 that is generated by the operation of the grinding tool 29 on the workpiece 27. Referring again to FIG. 2, it may be seen that the cuff 12 may be formed as a C-shaped, one-piece band 34, in keeping with an embodiment of the present invention. The one-piece band 34 may include a corrugated portion 36, secure fit, adjustability, and ease of attachment to a user's limb 23.

FIGS. 1 and 2 further illustrate a suction nozzle 14 in keeping with an embodiment of the present invention. The suction nozzle 14 may include a tubular funnel-shaped member 38, which forms a large generally rectangularly shaped mouth 41. A small connecting portion 43 may extend from an end of the suction nozzle 14 opposite the large mouth 41. The large mouth 41 may include a rim 45, disposed peripherally at the large mouth 41, and formed integrally therewith. The rim 45 may include an inwardly extending portion 47, configured to accommodate a user's digit, such as a thumb 25, or some other object that may be adjacent to 48 the suction nozzle 14. The suction nozzle 14 may also include an inwardly inclined lip or flange serving as a scraper portion 49, disposed along a portion of the rim 45, which scraper portion 49 is useful for scraping debris from the grinding tool 29, or other implement being used in proximity of the suction nozzle 14. The lip or scrapper extends angularly inwardly to help prevent debris from bouncing or splashing out of the funnel-shaped member 38.

In an embodiment of the present invention, the suction nozzle 14 may be connected to a curved suction tube 50 that is connected to the one-piece band 34 and to the suction line 18. The curved suction tube 50 may include a flexible joint 52 at some point along its length. As illustrated in FIG. 1, while the suction tube 50 may be curved so as to bias the suction nozzle against a user's digit, such as a thumb 25, the flexible joint allows for free movement of the digit 25, as the user is manipulating a workpiece 27. The suction nozzle 14 may thus remain in close proximity to a workpiece 27, through the range of motion of the user's digit 25, in order to effectively collect dust 32 generated as a workpiece 27 is manipulated in a grinding process.

The cuff 12 includes an upper rounded surface 44 which has a prophy paste cup 46 mounted thereon. The prophy paste cup is held in place by a pro-fee paste cup holder 48 so that the cup 46 contains a supply of prophy paste 40 which is worn on the limb of the user so that the user can conveniently gain access to the prophy paste 40 during a dental cleaning procedure.

A gauze roll 51 is detachably mounted on one side of the cuff 12 and is detachably held in place by a gauze holder 53. In this manner, the user can conveniently use the gauze roll 51 for cleaning the instruments during a dental procedure for a patient (not shown). The gauze roll can be conveniently removed after the dental procedure is completed, and a fresh new roll may be secured to the cuff 12 by means of the holder 53.

Figure 3:
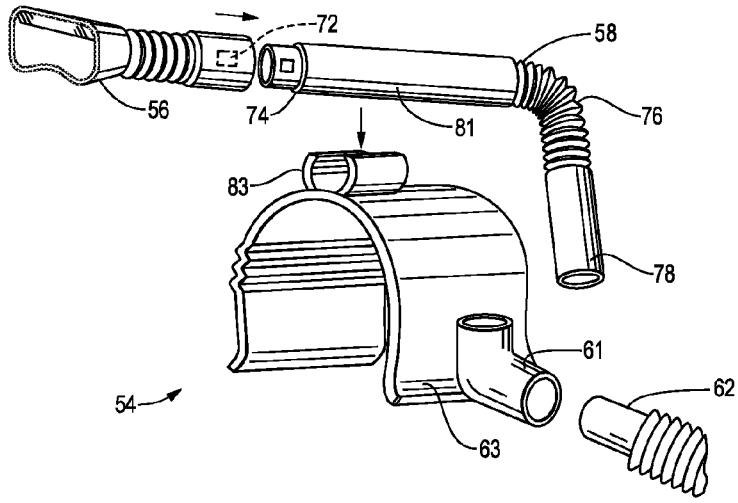
FIG. 3 is an exploded disassembled pictorial view of various components of another embodiment of the present invention.

Referring now to FIGS. 3 through 8, there are illustrated embodiments of the debris collecting apparatus 54, in accordance with the present invention. The embodiment illustrated in FIG. 3 is similar to the embodiment shown in FIGS. 1-2, except that several components of the debris collecting apparatus 54 are detachably connected as parts of an assembly, in contrast to the unitary 1-piece construction of the debris collecting apparatus 10 shown in FIG. 1. Detachable connections may facilitate cleaning and maintenance of the debris collecting apparatus 54, as well as quick disconnection from, changes of attachments to, a vacuum device such as a suction line 62. FIG. 3 shows that a suction nozzle 56 according to the present invention, may be detachably connected to a removable curved suction tube 58. Removable curved suction tube 58 may be detachably connected to an L-shaped connector 61, which is attached to the C-shaped band 63.

Figure 4:
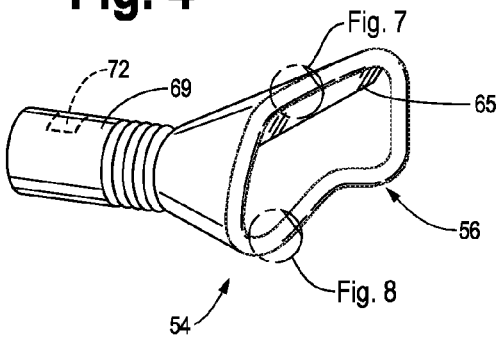
FIG. 4 is an enlarged pictorial view of a debris collecting apparatus of the embodiment of FIG. 3 of the present invention.
Figure 5:
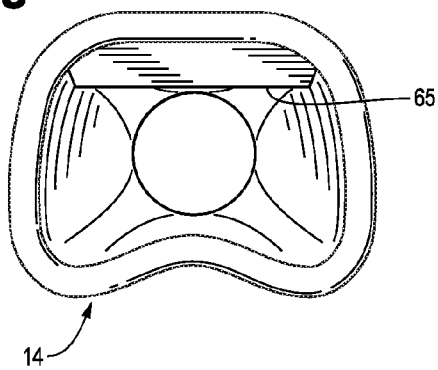
FIG. 5 is an enlarged face view of a debris collecting apparatus of the embodiment of the present invention of FIG. 3.
Figure 6:
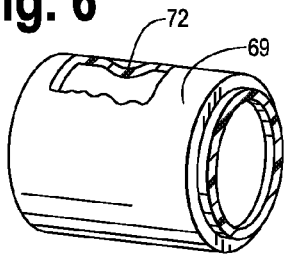
FIG. 6 is an enlarged pictorial view of a connector portion of the embodiment of the present invention of FIG. 3.
Figure 7:
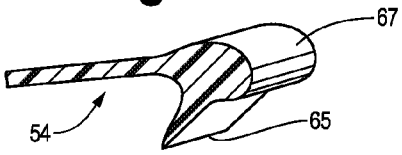
FIG. 7 is an enlarged detail sectional view of the respective encircled area of FIG. 6, illustrating a rim and scraper portion of the embodiment of the present invention of FIG. 3.
Figure 8:
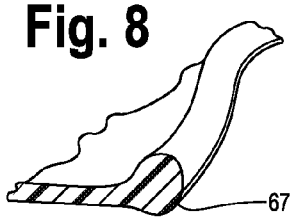
FIG. 8 is an enlarged detail sectional view of the respective encircled area of FIG. 6, illustrating a rounded rim portion of the embodiment of the present invention of FIG. 3.

The suction nozzle 56 illustrated in FIGS. 3 through 8, is similar to the suction nozzle illustrated in FIGS. 1-2, in that suction nozzle 56 also includes a scraper portion 65. As seen in FIGS. 7-8, scraper portion 65 of suction nozzle 56 may be configured as a V-shaped knife edge. As further illustrated in FIGS. 7-8, suction nozzle 56 may include a bulbous rounded rim 67. FIGS. 4 and 6 illustrate a small tapered connector portion 69, which is similar to connector portion 43, shown in FIGS. 1-2, except that connector portion 69 includes a detent which is receivable by an opening 74 in the removable curved suction tube 58 illustrated in FIG. 3, to provide a detachable connection.

Referring again to FIG. 3, there is seen a curved suction tube 58, with an end 78 that detachably connects with L-shaped connector 61. Curved suction tube 58 may also include a flexible joint 76, to accommodate positioning around C-shaped band 63, and to provide adjustable positioning and freedom of motion of the suction nozzle 56, which may be detachably connected to the removable suction tube 58. L-shaped connector 61 may provide for connection of the debris collecting apparatus 54, to suction line 62. Curved suction tube 58 may also include an intermediate portion 81, which is removably connectable to clamp 83, which itself may be disposed on C-shaped band 63, for positioning and stability of curved suction tube 58.

Figure 9:
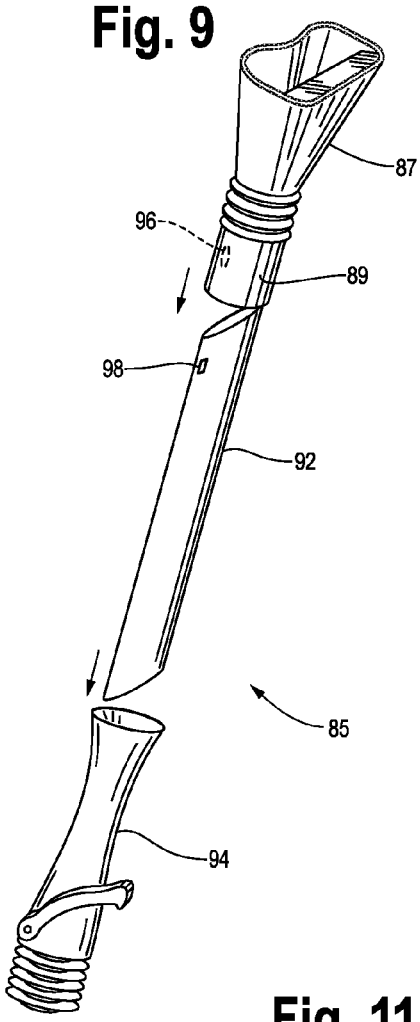
FIG. 9 is a pictorial view of another embodiment of the present invention.

An additional embodiment of the debris collecting apparatus 85 of the present invention is illustrated in FIG. 9. There is seen a suction nozzle 87, that includes a small straight connector portion 89. Small straight connector portion 89 is similar to small tapered connector portion 69, except that it is straight, rather than tapered. The debris collecting apparatus 85 of the embodiment illustrated in FIG. 9 is similar to the debris collecting apparatus 10, described above, except that in the embodiment shown on FIG. 9, small straight connector portion 69 may be detachably connected to coupler tube 92, which may be, in turn, detachably connected to a vacuum source such as a suction line 94. Similarly to the detent 72 disposed on small tapered connector portion 69, small straight connector portion 89 may include a detent 96, that is accessible by an opening 98, in coupler tube 92, to facilitate a quickly detachable connection between small straight connector portion 89 and coupler tube 92.

Figure 10:
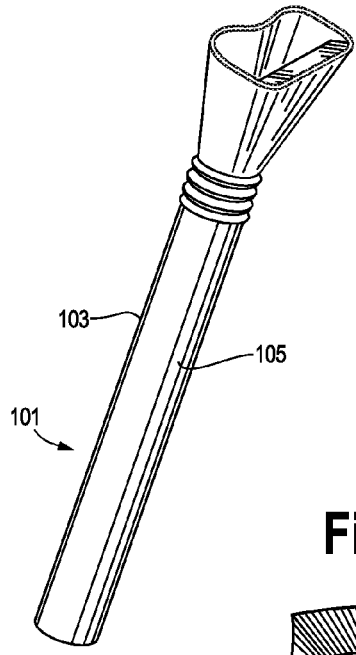
FIG. 10 is a pictorial view of yet another embodiment of the present invention, illustrating it in the process of being assembled.

FIG. 10 illustrates an embodiment of the debris collecting apparatus 101 of the present invention, which embodiment is similar to debris collecting apparatus 10, described above, except that debris collecting apparatus 101 includes a suction nozzle 103 that is similar to suction nozzle 87, but includes a long tubular neck portion 105, for connecting to a vacuum source such as a vacuum line 94 (shown in FIG. 9).

Figure 12:
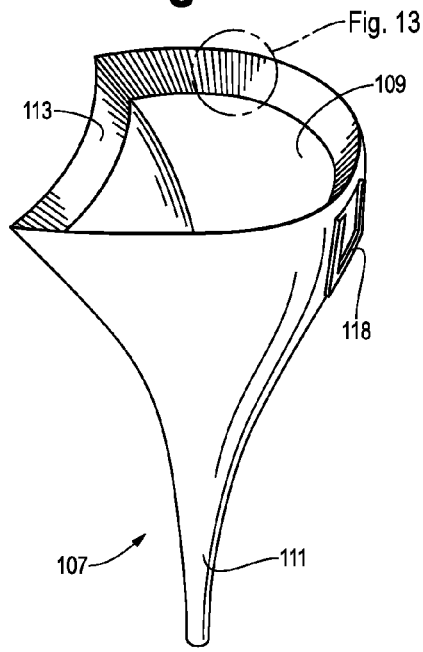
FIG. 12 is a reduced scale pictorial view of the embodiment of the present invention shown in FIG. 11, illustrating it with its cup holder removed for illustration purposes.
Figure 11:
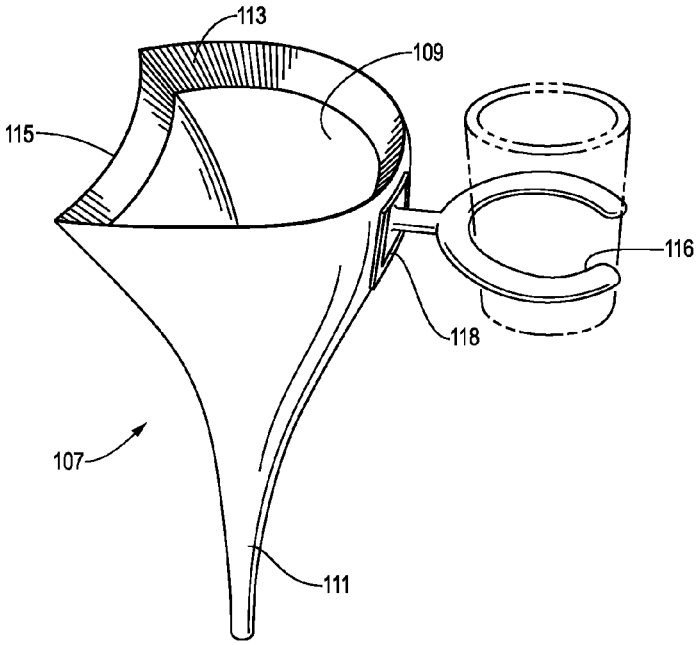
FIG. 11 is a pictorial view of still another embodiment of the present invention.
Figure 13:
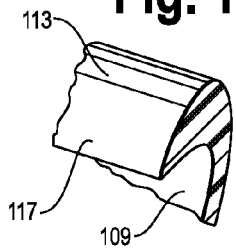
FIG. 13 is an enlarged detail sectional view of the encircled portion of FIG. 12.

FIGS. 11 through 13 illustrate yet another embodiment of a debris collecting apparatus 107, in accordance with the present invention. The debris collecting apparatus shown in FIGS. 11-13 includes a large mouth 109, and a small connector portion 111 disposed at an end of the debris collecting apparatus 107 that is opposite the large mouth 109 thereof. FIG. 13 shows a detailed view of a mouth rim 113, that is disposed on, and extends along at least a portion of the large mouth 109. The mouth rim 113 includes an inwardly extending portion 115, that is similar to the inwardly extending portion 47 of the debris collecting apparatus 10 illustrated in FIGS. 1-2. However, the mouth rim 113 illustrated in FIG. 13 may include a lip or V-shaped flange 117, configured to prevent debris, liquid, or materials that enter the debris collecting apparatus 107, from bouncing or splashing out of the debris collecting apparatus 107.

The apparatus 107 is designed to collect debris in general, but its presently preferred use is to receive spittle from a dental patient (not shown) seated in a dental chair (not shown) to eject unwanted debris from the mouth of the patient. A cup holder 116 may be provided on the apparatus 107 to releasably hold a drinking cup (not shown) which may be filled with water or other mouth rinse to facilitate the patient to rinse his or her mouth with water to remove debris from the mouth. A bracket 118 on the outside of the apparatus 107 enables the holder 116 to be removed therefrom for convenient cleaning or storage.

Figure 14:
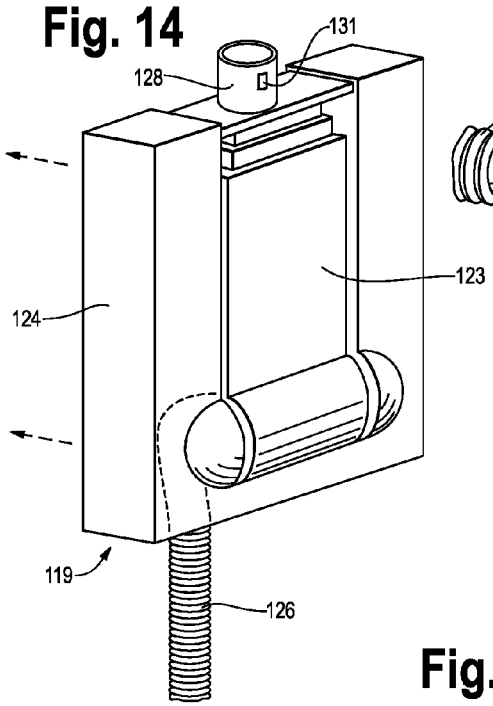
FIG. 14 is a pictorial view of a further embodiment of a debris collecting apparatus according to the present invention, wherein the apparatus is shown in a stored position with a suction line attached.
Figure 15:
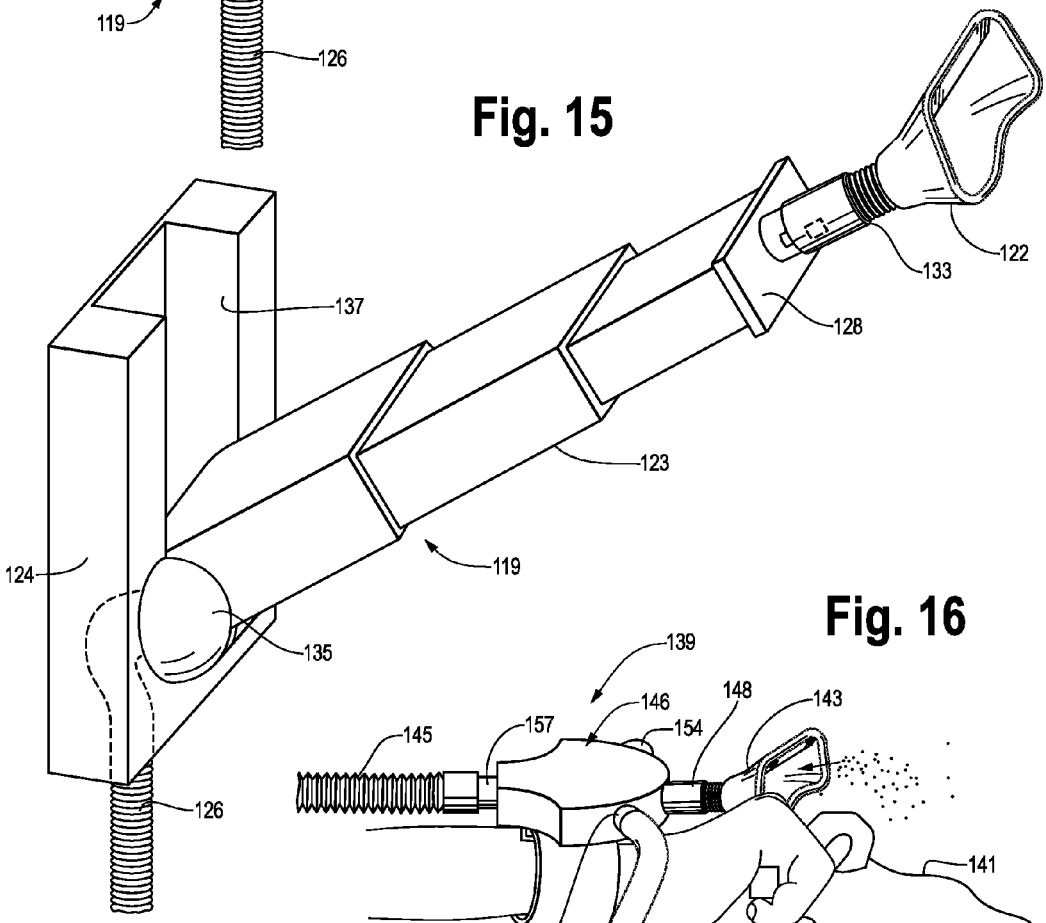
FIG. 15 is a pictorial view of the embodiment of the invention illustrated in FIG. 14, illustrating it in an extended portion, and illustrating the attachment of the vacuum nozzle.

FIGS. 14-15 illustrate yet another embodiment of a debris collecting apparatus 119, in accordance with the present invention. As shown in FIG. 15, debris collecting apparatus 119 includes a suction nozzle 122 detachably connected to a telescoping tube 123, that is rotatably attached to a housing 124 that may be, on turn, attachable to a wall or other surface conveniently located near a location where grinding or machining frequently occurs. The housing 124 is connected to a vacuum source such as a suction line 126. An adapter 128 may be disposed at the free end of the telescoping tube 123. Adapter 128 includes a detent opening 131, for receiving detent 133, disposed on suction nozzle 122, for detachably connecting suction nozzle 122 to adapter 128, in similar fashion as detents 72 and 96 are received by respective openings 74 and 98, for the detachable connection of respective suction nozzles 56 and 87. Telescoping tube 123 and housing 124 may be configured to provide for fluid communication between the suction line 126 connected to the housing 124, and the suction nozzle 122 connected to adapter 128. A hinge 135 may be provided as part of the housing 124, for the rotatable connection of telescoping arm 123, and housing 124 may also include a pocket opening 137, for receiving telescoping arm 123 when it is collapsed and rotated toward housing 124, for storage, as illustrated in FIG. 14.

Figure 17:
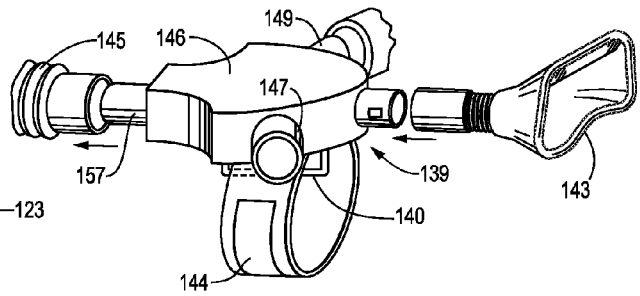
FIG. 17 is a pictorial view of the embodiment of a debris collecting apparatus of FIG. 16, further illustrating it in the process of being connected to a vacuum nozzle and other attachments.
Figure 18:
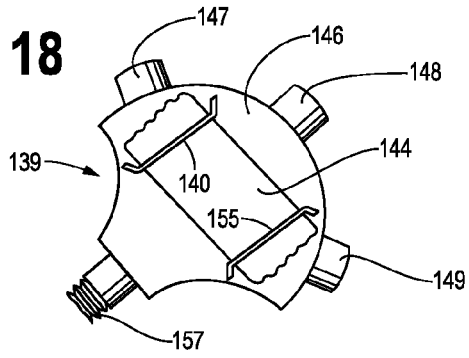
FIG. 18 is a bottom view of the embodiment of the debris collecting apparatus of FIG. 16, illustrating the manner of attachment of an adjustable band to a manifold, the band being shown broken away for illustration purposes.

FIGS. 16-19 illustrate yet another embodiment of a debris collecting apparatus 139, according to the present invention. As shown in FIG. 18, band retainers 140, 155 may be provided, to receive an adjustable band 144 for encircling a portion of a user's limb, for example, a user's wrist. This allows the debris collecting apparatus 139, to passively remain in close proximity to a grinding operation being performed by a user, and thus effectively collect dust and debris generated during the process, without the user having to actively grasp the debris collecting apparatus 139. As a result, the user can utilize the limb to which the debris collecting apparatus 139 is attached, for the performance of the work at hand, thus freeing up other limbs for assistance with the task, for holding a workpiece, or for the user to brace or support herself.

Figure 16:
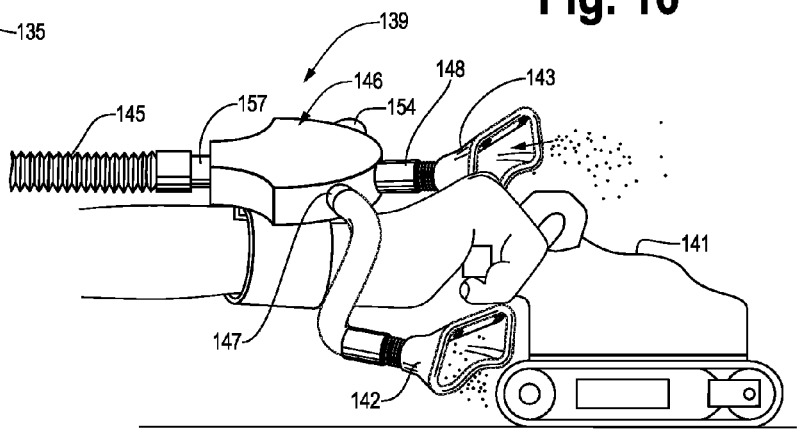
FIG. 16 is a pictorial view of still another embodiment of a debris collecting apparatus according to the present invention, illustrating the use of this embodiment for belt sanding.

As further illustrated in FIG. 16, when attached to a user the debris collecting apparatus remains in close proximity to a power tool 141 such as a belt sander, as it is operated by a user. The debris collecting apparatus 139 includes suction nozzles 142, 143, positioned to effectively capture dust and debris generated by the power tool 141. Suction nozzles 142, 143 are connected to a manifold 146, which is, in turn, connected to a vacuum source such as a suction line 145.

Figure 19:
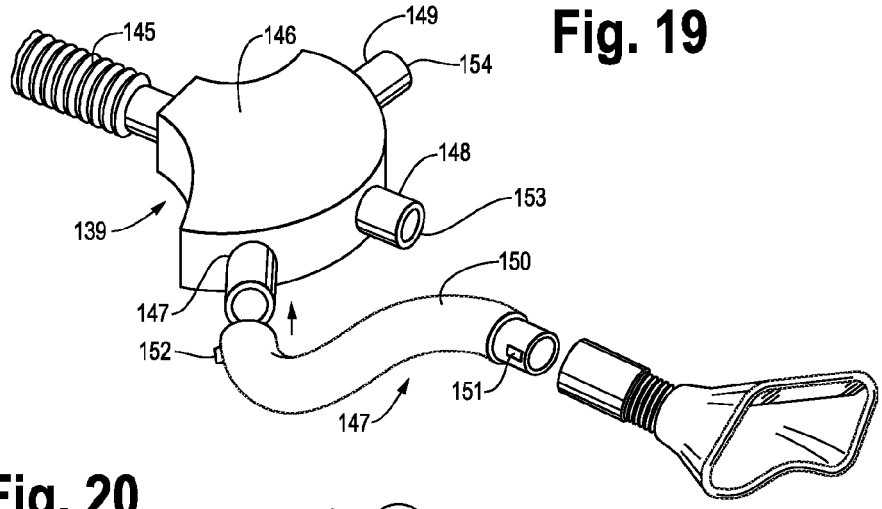
FIG. 19 is a pictorial view of the embodiment of a debris collecting apparatus of FIG. 16, illustrating it in the process of being assembled to an extender tube.

As seen in FIG. 19, manifold 146 may include ports 147, 148, 149, to which suction nozzles 142, 143 may be detachably connected. It is to be appreciated that other embodiments may include any number of open ports without deviating from the inventive concept. As shown in FIG. 17, manifold 146 may also include a vacuum connector 157, similar to vacuum connector 16, as described above, to provide for a detachable connection to suction line 145. In addition, to better position suction nozzle 142 in relation to the workspace or workpiece, for effective debris collection, extender tube 150 may be attached to port 147, and suction nozzle 142 may be, in turn, attached to extender tube 150. To provide for a detachable connection between extender tube 150 and suction nozzle 142, similarly to the detachable connection provided by the engagement and disengagement of detent 72 with opening 74 described above, extender tube may include a detent opening 151, for receiving a detent disposed on suction nozzle 142. To similarly provide for a detachable connection between extender tube 150 and port 147, a detent 152 may be disposed on extender tube 150, which detent 152 is receivable by an opening on port 147.

As illustrated in FIG. 19, caps 153, 154 may be provided in connection with an embodiment of the present invention, to cover ports 148, 149, when they are not in use. When a suction nozzle 142 is connected to port 147, either directly, or indirectly, through connection to extender tube 150, covering unused ports 148, 149 with caps 153, 154 may beneficially facilitate greater suction force through port 147.

Figure 20:
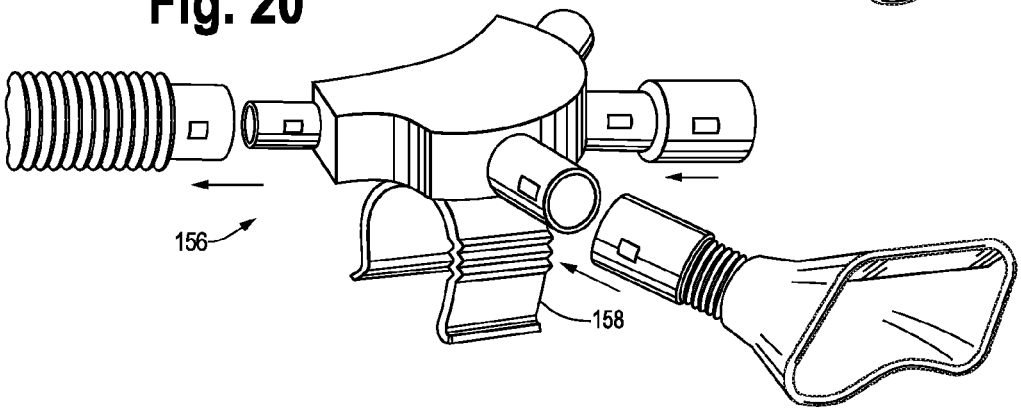
FIG. 20 is a pictorial view of yet another embodiment of a debris collecting apparatus according to the present invention, illustrating it in the process of being assembled.

FIG. 20 illustrates another embodiment of the debris collection device 156, in accordance with the present invention. In this embodiment, a C-shaped band, similar to C-shaped band 34 described above, may be attached to debris collection device 156, for quick and convenient removable attachment to a user's limb.

Figure 21:
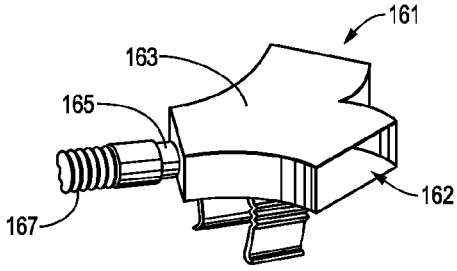
FIG. 21 is a pictorial view of a still further embodiment of a debris collecting apparatus in accordance with the present invention, illustrating two open ports.

FIG. 21 illustrates yet another embodiment of the debris collection device 160, in accordance with the present invention. This embodiment includes a manifold 163 with two open ports 161, 162 for collection of debris when the debris collection device 160 is connected to a vacuum source, such as a suction line. The arrangement of open ports 161, 162 provides for the collection of debris generated on either side of a user's limb when the debris collection device 160 is connected to a vacuum source, and attached to a user's wrist. It is to be appreciated that other embodiments may include any number of open ports without deviating from the inventive concept. Manifold 146 may also include a vacuum connector 165, similar to vacuum connector 16, as described above, to provide for a detachable connection to suction line 167.

Although the invention has been described with reference to the above examples, it will be understood that many modifications and variations are contemplated within the true spirit and scope of the embodiments of the invention as disclosed herein. Many modifications and other embodiments of the invention set forth herein will come to the mind of one skilled in the art to which the invention pertains, having the benefit of the teachings presented in the foregoing descriptions and the associated drawings. Therefore, it is to be understood that the invention shall not be limited to the specific embodiments disclosed and that modifications and other embodiments are intended and contemplated to be included within the scope of the appended claims. Although specific terms are employed herein, they are used in a generic and descriptive sense only and not for purposes of limitation.

What is claimed is:

1. A suction nozzle for attachment in fluid communication with a vacuum source, to collect debris, the nozzle comprising:

a tubular funnel-shaped member having a large mouth at one end, for receiving the debris, and having a small connector portion at an opposite end for attaching the nozzle to the vacuum source;

the mouth having a rim with one portion thereof extending inwardly toward the center of the mouth, for accommodating adjacent objects; and a scraper portion integral with, and extending inwardly from, the rim, for helping remove debris from instruments.

2. A suction nozzle according to claim 1, wherein the tubular member is a one-piece construction composed of a plastic material.

3. A method of making the suction nozzle of claim 1, further including molding the nozzle from a plastic material.

4. A suction nozzle according to claim 1, wherein the nozzle includes a cuff for attaching the nozzle to a limb of a user.

5. A suction nozzle according to claim 1, wherein the nozzle is attachable to a telescoping arm, the telescoping arm being, in turn, attached to a housing attachable in fluid communication with the vacuum source.

6. A suction nozzle according to claim 5, wherein the telescoping arm is rotatably attached to a housing.

7. A suction nozzle according to claim 1, wherein the nozzle is attached to a coupler tube that is, in turn, attachable in fluid communication with the vacuum source.

8. A suction nozzle for attachment in fluid communication with the vacuum source, to collect debris, the nozzle comprising:

a tubular funnel-shaped member having a large mouth at one end, for receiving the debris, and having a small connector portion at an opposite end for attaching the nozzle to the vacuum source;

the mouth having a rim with one portion thereof extending inwardly toward the center of the mouth, for accommodating adjacent objects; and a lip extending inwardly from, the rim, for helping deflect debris inwardly into the funnel-shaped member, to help prevent debris from bouncing or splashing out of the funnel-shaped member.

9. A suction nozzle according to claim 8, further including attaching means for securing the nozzle to a limb of the user, said means having a holder for securing releasable thereto an absorbent cleaning material.

10. A suction nozzle according to claim 9, further including a device for attaching removably a prophy paste cup to said attaching means.

11. A suction nozzle assembly for attachment to a user's limb, and attachment in fluid communication to a vacuum source, to collect debris, the nozzle assembly comprising:

a tubular funnel-shaped member having a large mouth at one end, for receiving the debris, and having a small connector portion at an opposite end for attaching the nozzle to the vacuum source;

the mouth having a rim with one portion thereof extending inwardly toward the center of the mouth, for accommodating adjacent objects;

a scraper portion integral with, and extending inwardly from, the rim, for helping remove debris from instruments; and a cuff attached to the funnel-shaped member, for attaching the nozzle assembly to a user's limb.

12. The nozzle assembly of claim 11, wherein the funnel-shaped member includes a flexible joint disposed between the small connector portion, and the rim of the mouth.

13. The nozzle assembly of claim 12, wherein the cuff includes a corrugated portion.

14. A method for making a nozzle for the collection of debris, the method comprising:

providing a tubular funnel-shaped member which member has a large mouth at one end, for receiving the debris, and which member has a small connector portion at an opposite end for attaching the nozzle in fluid communication to the vacuum source; and providing a scraper portion integral with, and extending inwardly from, the rim, for helping remove debris from instruments.

15. The method of claim 14, further including the step of attaching a cuff to the funnel-shaped member, for attaching the nozzle assembly to a user's limb.

* * * * *